US005729087A

United States Patent [19]

Chien

[11] Patent Number: 5,729,087

[45] Date of Patent: Mar. 17, 1998

[54] INVERSION-TYPE FED STRUCTURE HAVING AUXILIARY METAL ELECTRODES

[75] Inventor: Ho-Ching Chien, Hsinchu, Taiwan

[73] Assignee: Industrial Technology Research Institute, Hsin-Chi, Taiwan

[21] Appl. No.: 697,715

[22] Filed: Aug. 28, 1996

Related U.S. Application Data

[62] Division of Ser. No. 374,900, Jan. 19, 1995, Pat. No. 5,578,225.

[51] Int. Cl.[6] ..... H01J 1/62; H01J 63/04; H01J 1/02; H01J 1/16

[52] U.S. Cl. ..... 313/495; 313/309; 313/336; 313/351

[58] Field of Search ..... 313/309, 311, 313/336, 346 R, 351, 495, 505–509; 315/334, 337; 216/11, 23–25, 41; 437/89, 228, 927; 56/643.1, 657.1, 659.11

[56] References Cited

U.S. PATENT DOCUMENTS

| | | | |
|---|---|---|---|
| 5,216,324 | 6/1993 | Curtin | 313/495 |
| 5,445,898 | 8/1995 | Budzilek et al. | 313/506 X |
| 5,445,899 | 8/1995 | Budzilek et al. | 313/506 X |
| 5,559,399 | 9/1996 | Tanski et al. | 313/509 X |

OTHER PUBLICATIONS

"Improvement of Luminance and Luminous Efficiency of Surface–Discharge Color as PDP", by T. Shinoda et al. in SID 1991 Digest, pp. 724–727.

*Primary Examiner*—Walter E. Snow
*Assistant Examiner*—Mack Haynes
*Attorney, Agent, or Firm*—George O. Saile; Stephen B. Ackerman

[57] ABSTRACT

A field emission display that may be viewed through the back plate, thus providing increased luminous efficiency, and methods for making such a display, are described. A glass substrate is provided as a base for the display faceplate. There is a reflective, conductive layer over the glass substrate. A phosphor layer is formed over the reflective, conductive layer. A second glass substrate acts as a transparent base for the display baseplate, which is mounted opposite and parallel to the faceplate. A first transparent insulating layer is formed over the second glass substrate. There are parallel, transparent cathode electrodes with auxiliary metal electrodes, over the first insulating layer. Parallel, transparent gate electrodes are formed over, separate from, and orthogonally to the parallel, transparent cathode electrodes, and also have auxiliary metal electrodes. A second transparent insulating layer is between the gate electrodes and the cathode electrodes. A plurality of openings extend through the second insulating layer and the gate electrodes. At each opening is a field emission microtip connected to and extending up from a cathode electrode, whereby electrons may be selectively emitted from each microtip to form a display image on the faceplate phosphor layer, which is viewable through the baseplate.

9 Claims, 11 Drawing Sheets

FIG. 1 – Prior Art

INVERSION-TYPE FED STRUCTURE HAVING AUXILIARY METAL ELECTRODES

This application is a divisional of application Ser. No. 08/374,900, which was filed on Jan. 19, 1995 and now U.S. Pat. No. 5,578,225.

BACKGROUND OF THE INVENTION (1) Field of the Invention

The invention relates to flat panel displays, and more particularly to structures and methods of manufacturing field emission displays that provide for viewing of the display through the back plate, whereas the conventional method of viewing is through the front plate.

(2) Description of the Related Art

In display technology, there is an increasing need for flat, thin, lightweight displays to replace the traditional cathode ray tube (CRT) device. One of several technologies that provide this capability is field emission displays (FED). An array of very small, conical emitters is formed on a back plate, typically using a semiconductor substrate as the base, and are addressed via a matrix of columns and lines. These emitters are connected at their base to a conductive cathode, and the tips of the emitters are in close proximity to and are surrounded by a second conductive surface, usually referred to as the gate. When the proper voltages are applied to the cathode and gate, electron emission occurs from the emitter tips, with the electrons attracted to a third conductive surface, the anode, formed on an opposite face plate and on which there is cathodoluminescent material that emits light when excited by the emitted electrons. The viewer of the display typically views the display image thus formed through the face plate.

FIG. 1 is a cross-sectional view of a portion of a field emission display. Row electrodes 12, also called the cathode, are formed on a baseplate 10, over a buffer layer 11, and have emitter tips 14 mounted thereon. The emitters are separated by insulating layer 16. A column electrode 18, or gate, with openings 17 for the emitter tips, is formed on the insulating layer 16 and is formed perpendicular to the row electrodes. When electrons 20 are emitted, they are attracted to transparent conductive anode 22 and upon striking phosphor 23 mounted on the anode, light is emitted. However, light 26 that is emitted in the direction of a viewer of the display, who would be looking through glass plate 24, must travel through the phosphor 23, the anode 22 and the glass 24. The luminous efficiency is reduced primarily due to absorption by the phosphor.

Workers in the art are aware of this problem and have attempted to resolve it, with one approach disclosed in U.S. Pat. No. 5,216,324 (Curtin), in which the display image is viewed through the back plate, either by forming the conductive and insulating layers on the back plate of a transparent material, or making the conductive lines very thin, both of which increase the amount of light that can be transmitted to the viewer. A drawback to the approach of using transparent conductive materials, which include indium tin oxide and the like, is reduced conductivity compared to the more commonly used metallic materials. A problem with the embodiment using very thin lines is that very few emitter tips can be formed at each pixel, which decreases the luminous efficiency, and degrades the display uniformity, stability and reliability, as compared to a display having many tips at each pixel.

SUMMARY OF THE INVENTION

It is therefore an object of this invention to provide a flat panel display that may be viewed through the back plate, thus providing increased luminous efficiency.

Another object of the invention is to provide a flat panel display that may be viewed through the back plate and that has improved conductivity of the driving electrodes.

It is yet another object of this invention is to provide a method of fabricating a flat panel display that may be viewed through the back plate.

These objects are achieved by a field emission display having a baseplate and a faceplate. A glass substrate is provided that acts as a base for the faceplate. There is a reflective, conductive layer over the glass substrate. A phosphor layer is formed over the reflective, conductive layer. A second glass substrate acts as a transparent base for the baseplate which is mounted opposite and parallel to the faceplate. A first transparent insulating layer is formed over the second glass substrate. There are parallel, transparent cathode electrodes over the first insulating layer. Metallic auxiliary cathode electrodes are formed over the parallel, transparent cathode electrodes, and have a width less than the parallel, transparent cathode electrodes. Parallel, transparent gate electrodes are formed over, separate from, and orthogonally to the parallel, transparent cathode electrodes. There are metallic auxiliary gate electrodes over the parallel, transparent gate electrodes, having a width less than the parallel, transparent gate electrodes. A second transparent insulating layer is between the parallel, transparent gate electrodes and the parallel, transparent cathode electrodes. A plurality of openings extend through the second insulating layer and the parallel, transparent gate electrodes. At each of the openings is a field emission microtip connected to and extending up from one of the parallel, transparent cathode electrodes, whereby electrons may be selectively emitted from each of the field emission microtip to form a display image, on the phosphor layer of the faceplate, which is viewable through the baseplate.

These objects are also achieved by a field emission display having a baseplate and a faceplate. A glass substrate acts as a base for the faceplate. A reflective, conductive layer extends over the glass substrate. A phosphor layer is formed over the reflective, conductive layer. A second glass substrate acts as a transparent base for the baseplate which is mounted opposite and parallel to the faceplate. A first transparent insulating layer is formed over the second glass substrate. There are parallel cathode electrodes over the insulating layer. There are parallel gate electrodes formed over, separate from, and orthogonally to the parallel cathode electrodes. The intersections of the parallel cathode electrodes and the parallel gate electrodes are pixels of the display, wherein the parallel cathode electrodes and the parallel gate electrodes are patterned to cover only a portion of the pixels. A second transparent insulating layer is between the parallel gate electrodes and the parallel cathode electrodes. A plurality of openings extend through the second insulating layer and the parallel transparent gate electrodes. At each of the openings is a field emission microtip connected to and extending up from one of the parallel cathode electrodes.

These objects are still further achieved by a method for making a field emission display having a baseplate and a faceplate. A glass substrate is provided to act as the base for the faceplate. A reflective, conductive layer is formed over the glass substrate. A phosphor layer is formed over the first conductive layer. The faceplate is mounted opposite to and parallel to the baseplate on which is formed a first insulating layer. A first transparent conductive layer is formed over the first insulating layer. The first transparent conductive layer is patterned to form parallel, spaced cathode lines. First metal lines are formed over the parallel, spaced cathode lines, to a width less than the parallel, spaced cathode lines. A second insulating layer is formed over the parallel, spaced cathode lines and over the first insulating layer. A second transparent conductive layer is formed over the second insulating layer. The second transparent conductive layer is patterned to form parallel, spaced gate lines orthogonally to the parallel, spaced cathode lines. Second metal lines are formed over the parallel, spaced gate lines, to a width less than the parallel, spaced gate lines. First openings are formed in the parallel, spaced gate lines. Second openings are formed in the second insulating layer under the first openings. Electron emitting tips are formed in the second opening, over the parallel, spaced cathode lines.

These objects are still further achieved by a method for making a field emission display having a baseplate and faceplate. A glass substrate is provided to act as the base for the faceplate. A reflective, conductive layer is formed over the glass substrate. A phosphor layer is formed over the first conductive layer. The faceplate is mounted opposite to and parallel to the baseplate on which is formed a first insulating layer. A first conductive layer is formed over the first insulating layer. The first conductive layer is patterned to form parallel, spaced cathode lines having orthogonal cathode leads at pixels of the field emission display. A second insulating layer is formed over the parallel, spaced cathode lines and over the first insulating layer. A second conductive layer is formed over the second insulating layer. The second conductive layer is patterned to form parallel, spaced gate lines, orthogonal to the parallel, spaced cathode lines, having orthogonal gate leads at the pixels of the field emission display. First openings are formed in the orthogonal gate leads. Second openings are formed in the second insulating layer under the first openings. Electron emitting tips are formed in the second openings, on the orthognal cathode leads.

BRIEF DESCRIPTION OF THE DRAWINGS

FIG. 15 is a top view of a single pixel of the display structure of the fourth embodiment of the invention, in which FIG. 14 is taken along line 14—14.

DESCRIPTION OF THE PREFERRED EMBODIMENTS

Figure 2:
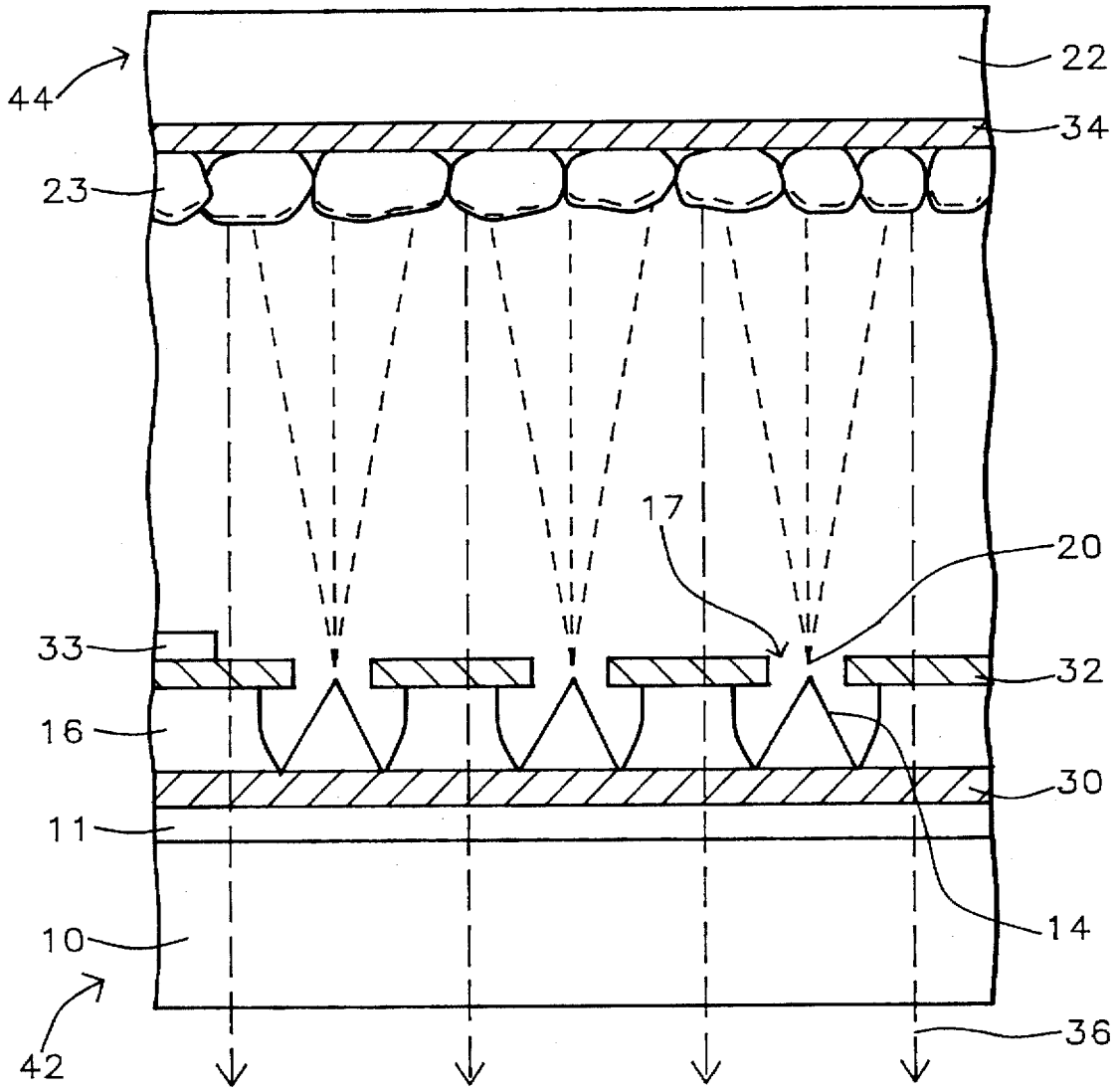
FIG. 2 is a cross-sectional representation of the first embodiment of the invention for an inversion-type FED structure.
Figure 3:
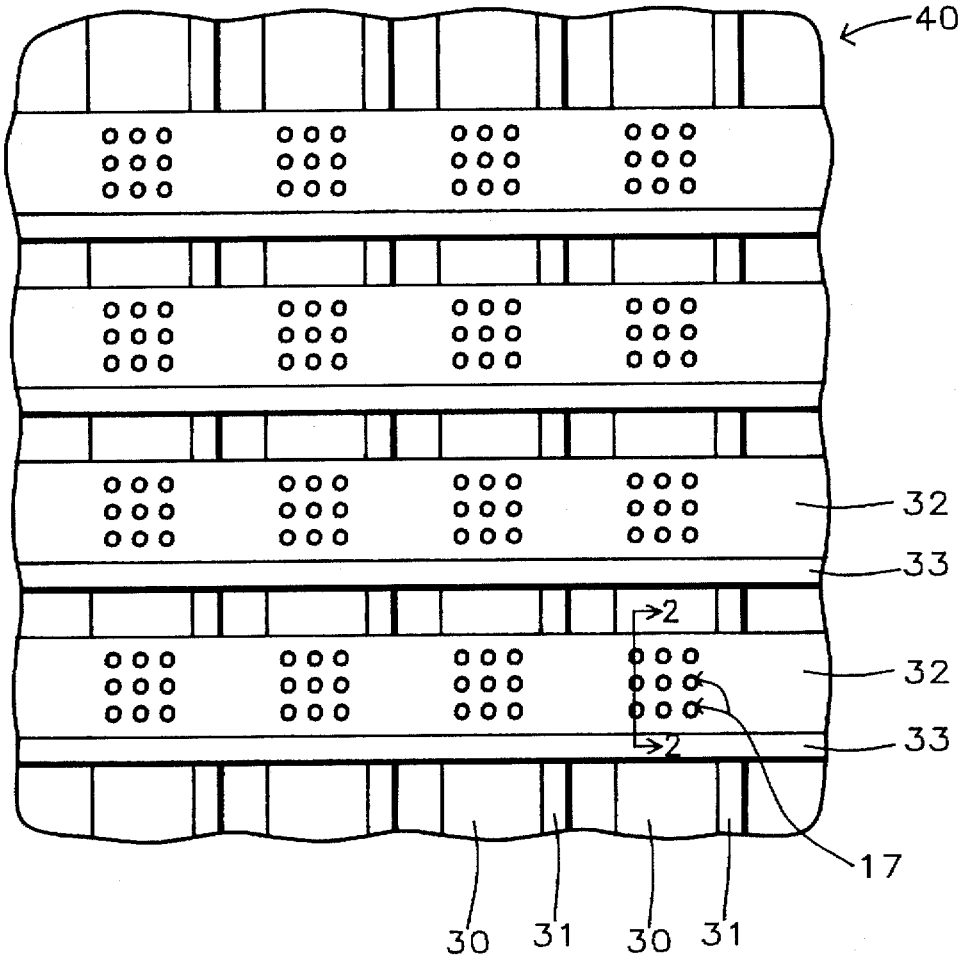
FIG. 3 a top view of the first embodiment structure of the invention, in which the cross-sectional representation of FIG. 2 is shown along line 2—2.

Referring now to FIGS. 2 and 3, a first embodiment of the invention is shown. A structure is described whereby the display image formed on the phosphor layer 23 at the front plate 44 is viewed through the back plate 42, to increase the luminous efficiency of the display. The FIG. 2 cross-section is taken along line 2—2 of the top view of FIG. 3, in which a group of 16 pixels 40 (out of hundreds of thousands of pixels on a typical display) is shown.

Figure 1:
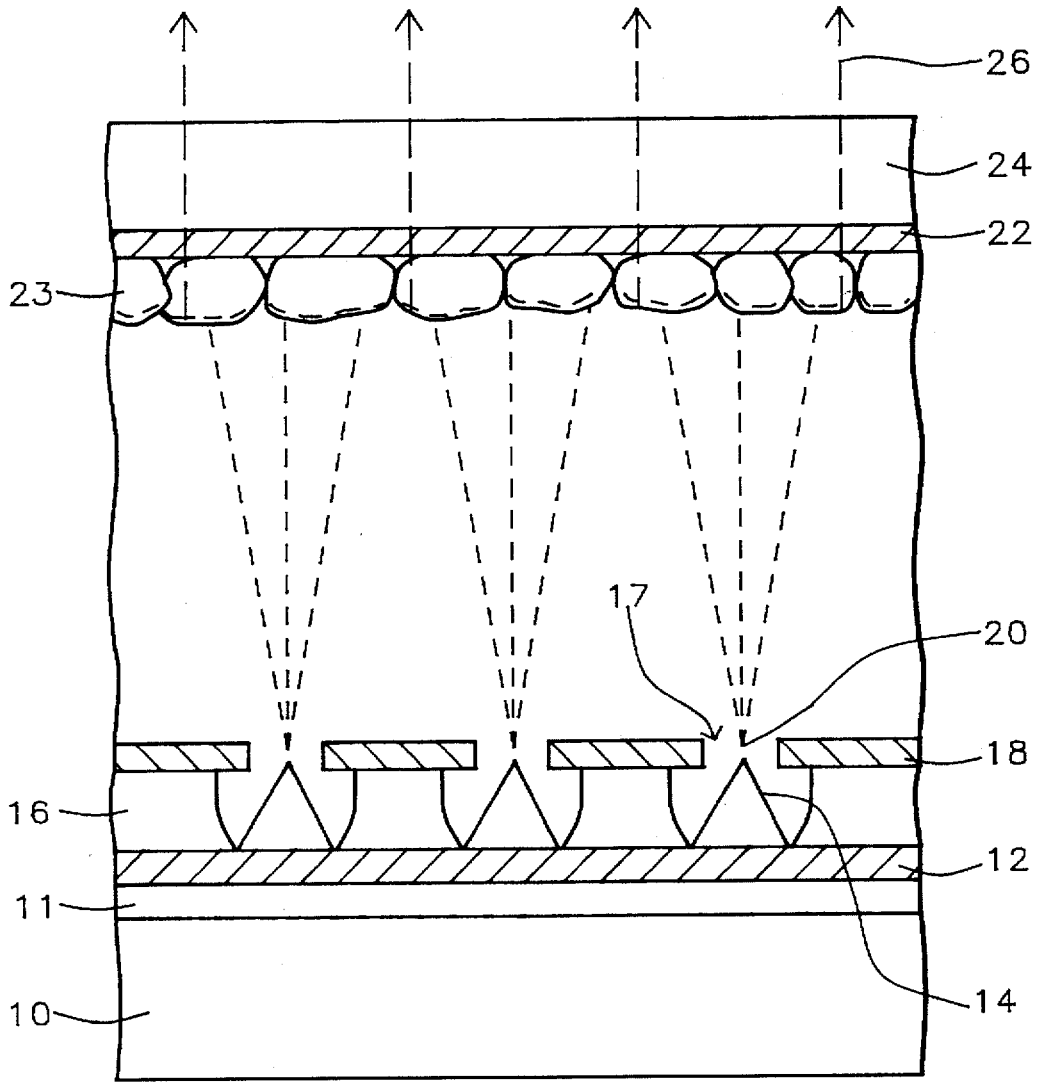
FIG. 1 is a cross-sectional representation of a related art field emission display, in which the display image is viewed through the front plate of the display.

The structure of the invention differs from the prior art structure of FIG. 1 in that the conductive layers at the back plate, gate electrodes 30 and cathode electrodes 32, are formed of transparent conductors, to allow for light transmission through these layers. The transparent conductors are formed of oxides of indium, tin, zinc and cadmium, and include indium tin oxide (ITO), indium zinc oxide (IZO), cadmium stannate (CTO) and the like. While these materials provide much better optical characteristics than thin metal films, their conductivity is not as high as metallic materials, which results in an undesirable increase in the RC time constant of an FED made solely with a transparent conductor gate and cathode.

Therefore, a key feature of this embodiment of the invention is the provision of metal auxiliary electrodes on the gate and cathode. Auxiliary metal cathode electrodes 31 are formed on the cathode electrodes 30, and auxiliary metal gate electrodes 33 are formed on the gate electrodes 32. These auxiliary electrodes are formed of Mo (molybdenum), Nb (niobium) or the like, and have a width that is a small portion of the width of the underlying transparent electrodes, so that a large portion of the display image may still be seen through the back plate 42. The auxiliary electrodes 31 and 33 are formed to a width of between about 5 and 10 percent of the width of the underlying electrodes 30 and 32, respectively, and improve the conductivity for these electrodes.

Figure 4A:
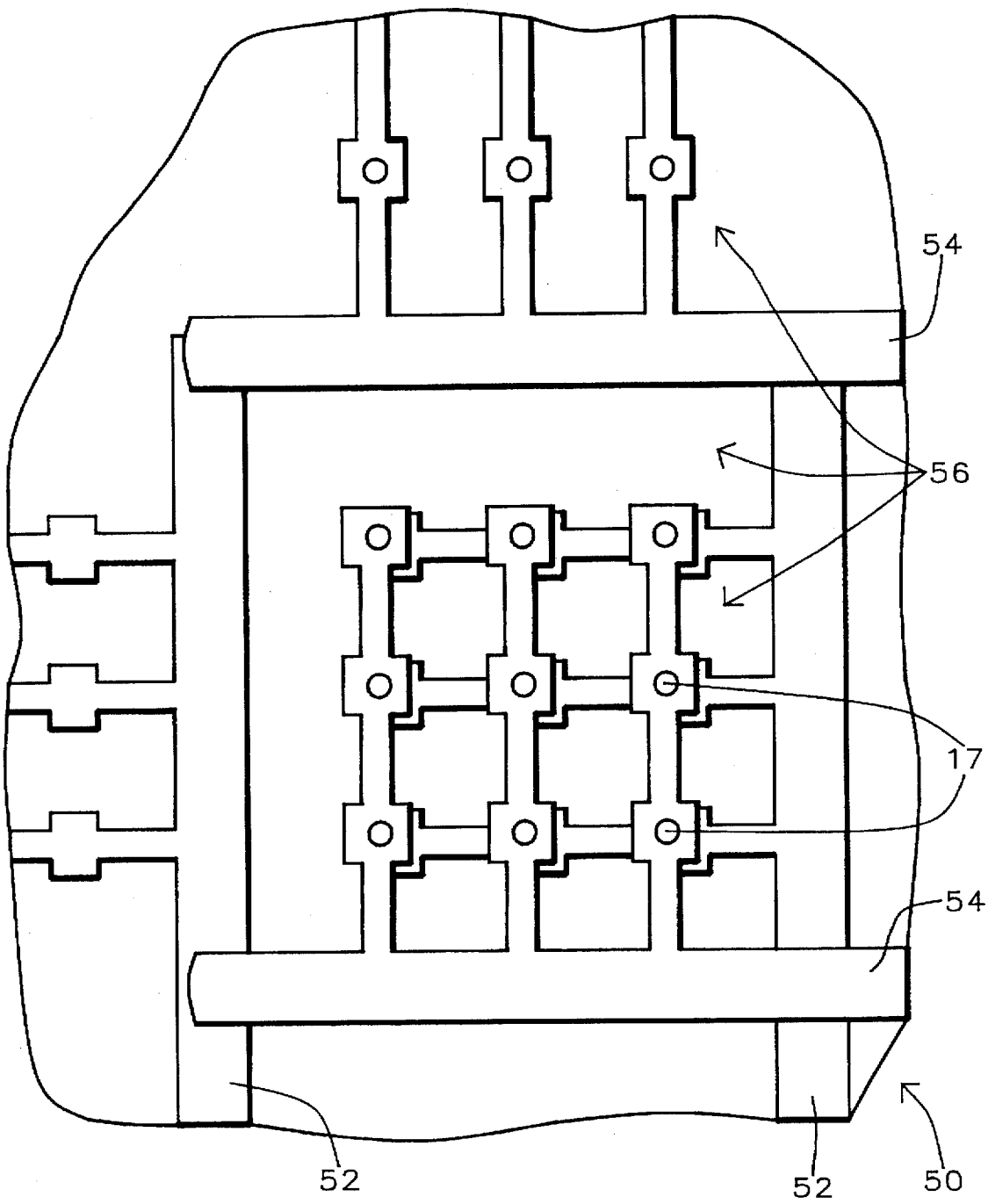
FIGS. 4A and 4B are top views of the second embodiment of the invention.
Figure 4B:
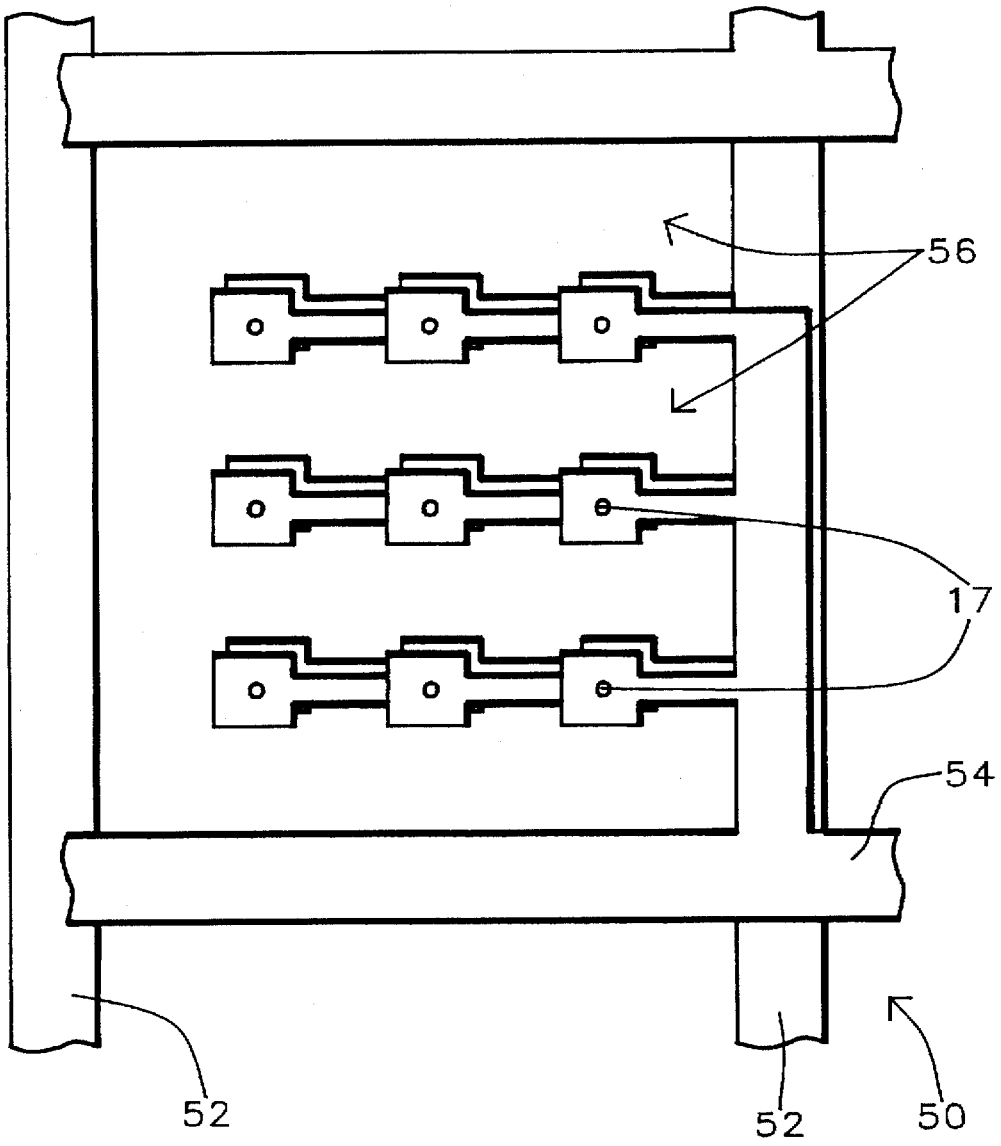

A second embodiment of the invention is now described in which a metal is used to form cathode 52 and gate 54, but at each pixel 50 a majority of the gate and cathode electrode surfaces have been removed to provide transparent regions 56 for light transmission through the backplate. One such pattern of forming the gate and cathode electrodes at the pixels is shown in FIG. 4A, in which an emitter would be formed under each opening 17, as in the previous Figures. By minimizing the surface area of each pixel that is covered by the metallic electrodes, the area available for light transmission through transparent regions 56 is maximized. Furthermore, the width of the lines for gate 54 and cathode 52 running between pixels is minimized as well. It will be understood by those having skill in the art that the invention is not limited to the FIG. 4A structure, but may contain a differing number of emitter tips, and may have differing patterning of the cathode electrodes 52 and gate electrodes 54. For example, FIG. 4B shows a generally similar structure to that of FIG. 4A, but has a design layout with even more area available for light transmission.

An example of this embodiment of the invention would be a pixel having 900 emitter tips in an array of 30 by 30 tips. For a pixel size of 300 by 300 micrometers this structure would have a pitch between emitters of about 10 by 10 micrometers. The metal lines patterned at each pixel and extending to the emitters would have a width of between about 4 and 5 micrometers, so that the open area would comprise between about 40 and 60 percent of the total area of the pixel. The shape of the metal lines at each emitter is not limited to the square shape shown in FIGS. 4A and 4B, but must be of sufficient size to allow for process tolerance.

Figure 5A:
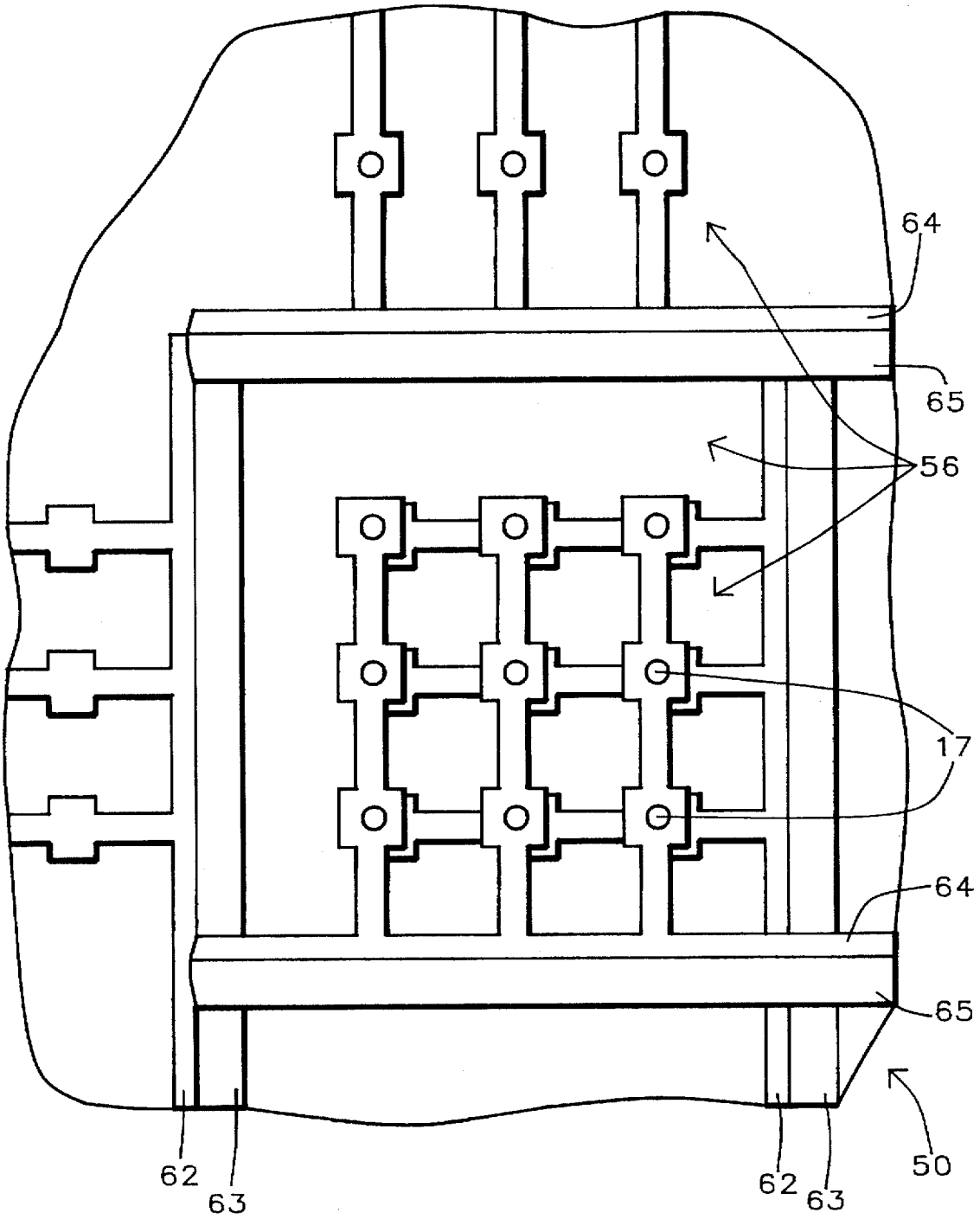
FIGS. 5A and 5B are top views of a third embodiment of the invention, which is a combination of the first and second embodiments.
Figure 5B:
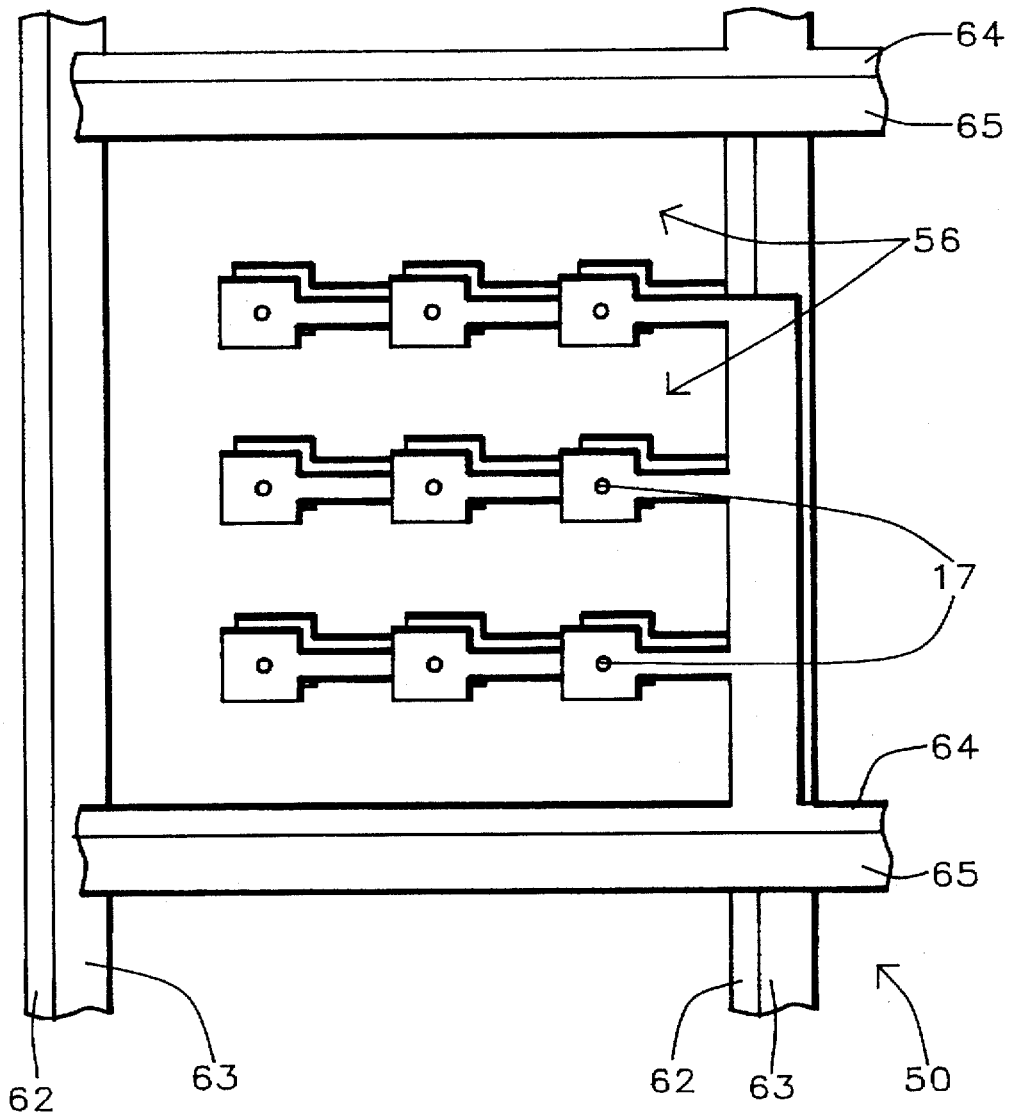
Figure 6:
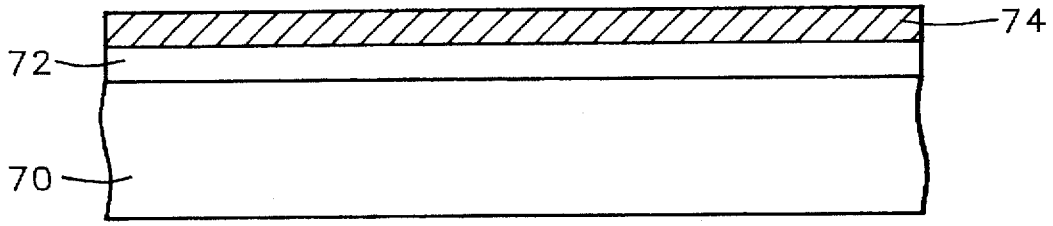
FIGS. 6 to 10 are a cross-sectional representation of a method for forming the inversion-type FED of the invention.

The first two embodiments of the invention may be combined to form a third embodiment, as shown in FIGS. 5A and 5B. The cathode electrodes 62 and gate electrodes 64 are formed of a transparent conductor, and auxiliary metal electrodes 63 and 65 are formed thereon, as in the first embodiment of the invention, while the pattern of the electrodes is formed to maximize the transparent areas 56 at each pixel 50. Two different design layouts are shown in FIGS. 5A and 5B, with the latter layout having somewhat more area available for light transmission.

Figure 7:
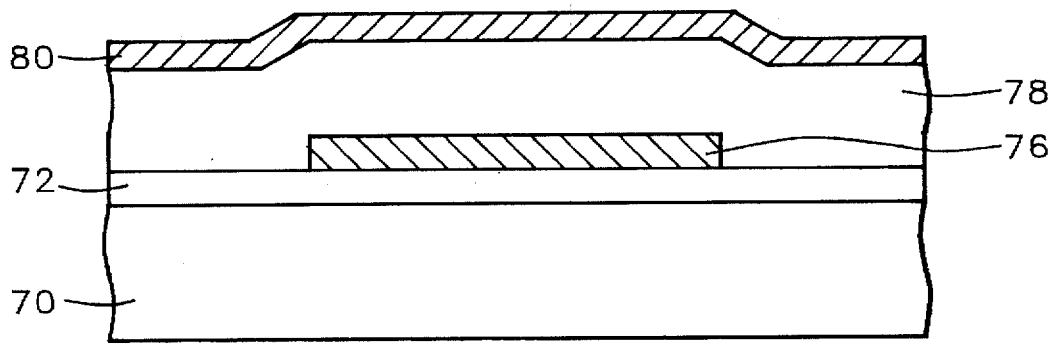

The method of forming the field emission display of the invention is now described, with reference to FIGS. 6 to 10. A transparent glass substrate 70 is provided, on which is formed a buffer layer 72 having a thickness of between about 5000 and 10,000 Angstroms, typically formed of silicon oxide ($SiO_2$), which is also transparent. A conductive layer 74 is formed on buffer layer 72 and in the two embodiments of the invention is either a transparent conductor, such as ITO or other materials stated earlier, or a metal, such as Mo, Nb or the like. Where a transparent conductor is used, it is formed to a thickness of between about 1000 and 2000 Angstroms, and is deposited by, for example, RF sputtering. A metal layer would be formed by sputtering to a thickness of between about 2000 and 4000 Angstroms. Layer 74 is then patterned by conventional lithography and etching to form the cathode 76, as shown in FIG. 7.

An insulator layer 78 is now formed to isolate the cathode and gate and to separate the emitter tips, and is formed of silicon oxide to a thickness of between about 6000 and 10,000 Angstroms, by PECVD (Plasma Enhanced Chemical Vapor Depostion). The gate layer 80 is then deposited and patterned in a similar manner as cathode 76, using similar materials for the two embodiments of the invention, and as described earlier. The gate electrodes are patterned into parallel strips, formed perpendicular to the cathode electrodes. The thickness of this layer where a transparent conductor is used is between about 1000 and 2000 Angstroms, and is between about 1500 and 2500 Angstroms when metal is used.

Figure 8:
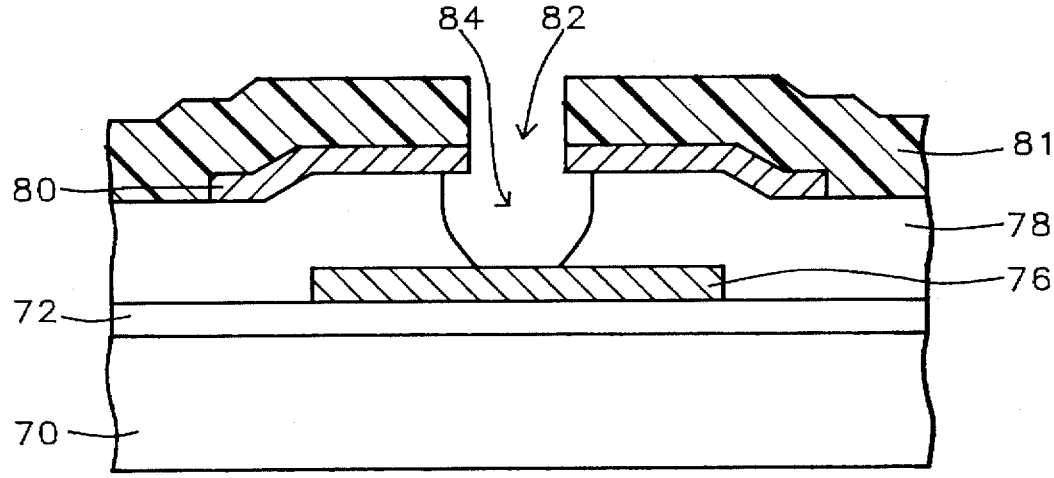

The gate is then patterned, as shown in Fig. 8, to provide openings 82 for formation of the field emitter tips. After forming a photoresist mask 81 by conventional lithography, anistotropic etching is performed using RIE (Reactive Ion Etching). When the gate is transparent, the etchant used depends on the type of etched material. For a metal gate, C12 (chlorine), SF6 (sulfur hexafluoride), or CF4 (carbon tetrafluoride), or the like may be used. A second opening 84 is then formed in insulator layer 78 by a wet etch, and the photoresist mask is removed.

Figure 9:
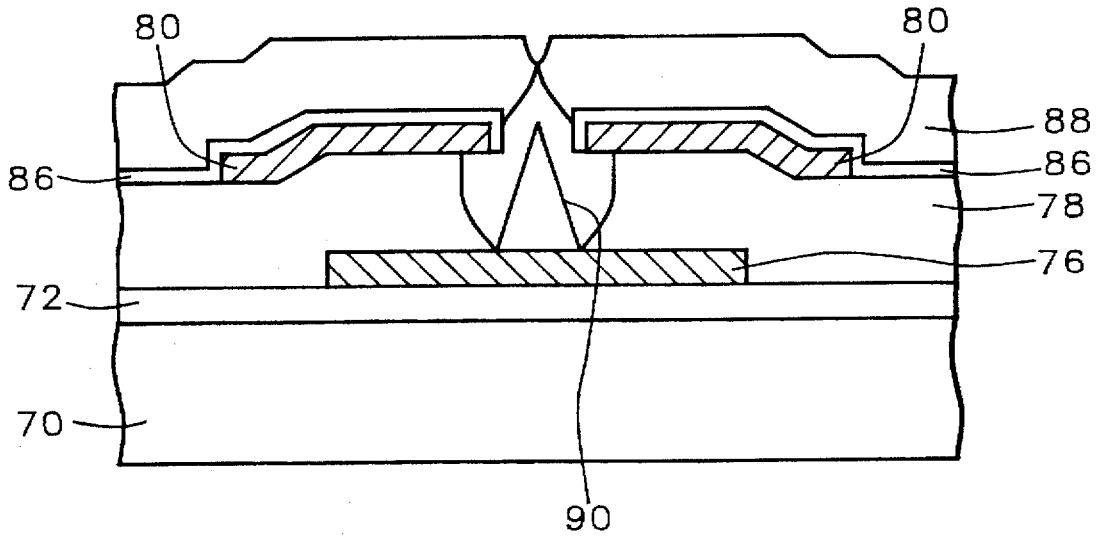
Figure 10:
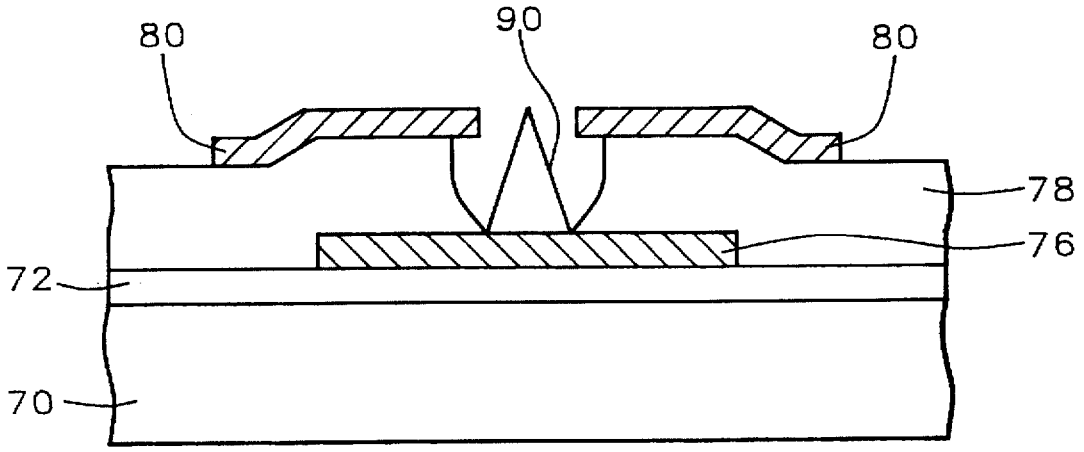

Referring now to FIG. 9, a sacrificial layer 86 is formed of Al (aluminum), Ni (nickel) or the like to a thickness of between about 3000 and 6000 Angstroms, using low angle deposition so that none of the material is deposited inside opening 84. The emitter tips 90 are then formed by vertical deposition of Mo or W (tungsten) or the like which results in the formation of layer 88 on top of sacrificial layer 86 and which closes off above the emitter openings, as shown. As shown in FIG. 10, the sacrificial layer 86 and layer 88 are removed by etching in NaOH (sodium hydroxide), or the like, to leave the completed structure of the invention.

Figure 11:
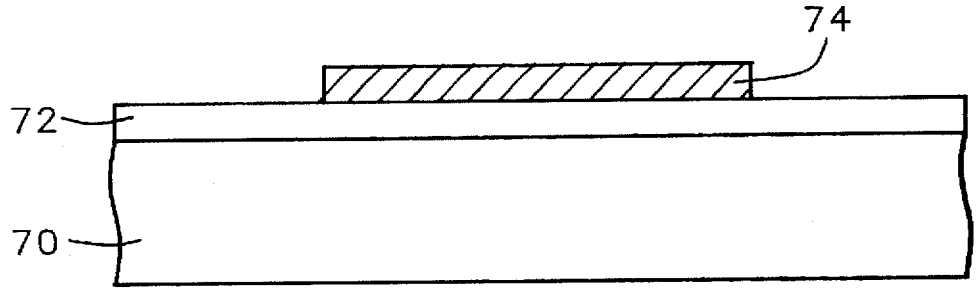
FIGS. 11 to 14 are a cross-sectional representation of a method for forming a fourth embodiment of the invention.
Figure 12:
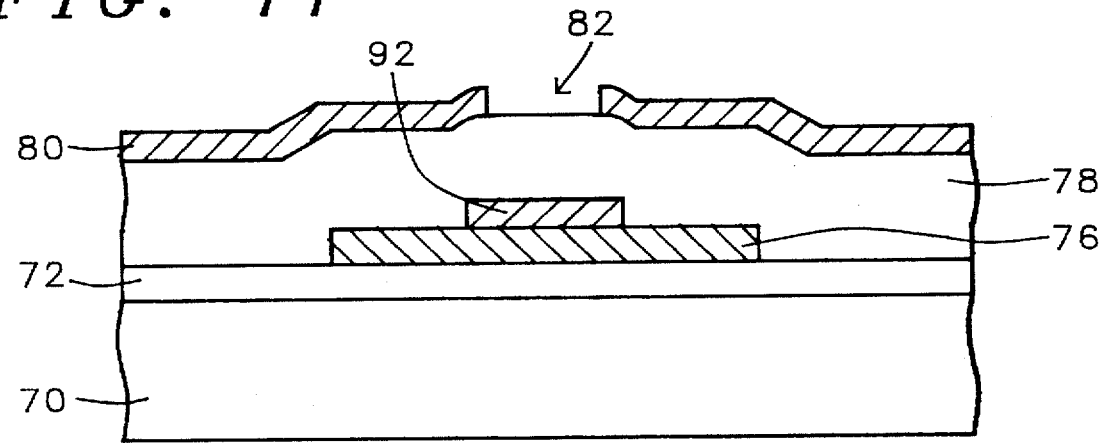

A fourth embodiment of the invention is described with reference to FIGS. 11 to 14. It is similar to the first embodiment, but includes the addition of using the auxliary metal electrode depositions to form metal structures at each emitter location. Processing is as stated earlier up to the structure of FIG. 6, with layer 74 being one of the transparent conductive materials, such as ITO. This layer is then patterned as shown in FIG. 11, to form cathode 76. During deposition of auxiliary metal cathode electrode (see reference character 31 in FIG. 3), an additional metal pad 92 is formed, through a mask formed by conventional lithography and etching. The metal pad is formed on transparent cathode 76, as shown in FIG. 12.

Insulator layer 78 and a transparent gate 80 are formed, as earlier described. The gate is then patterned, as shown in FIG. 12, to provide openings 82 for formation of the field emitter tips.

Figure 13:
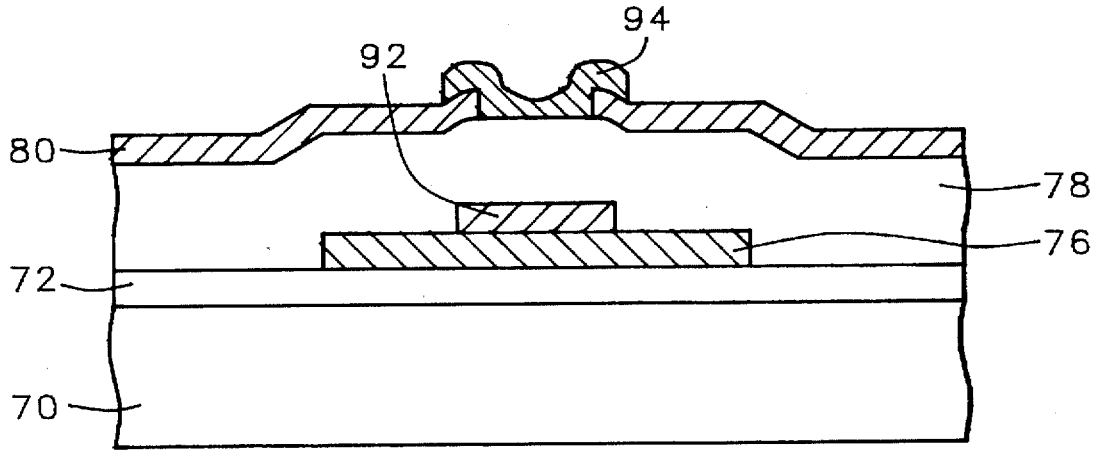
Figure 14:
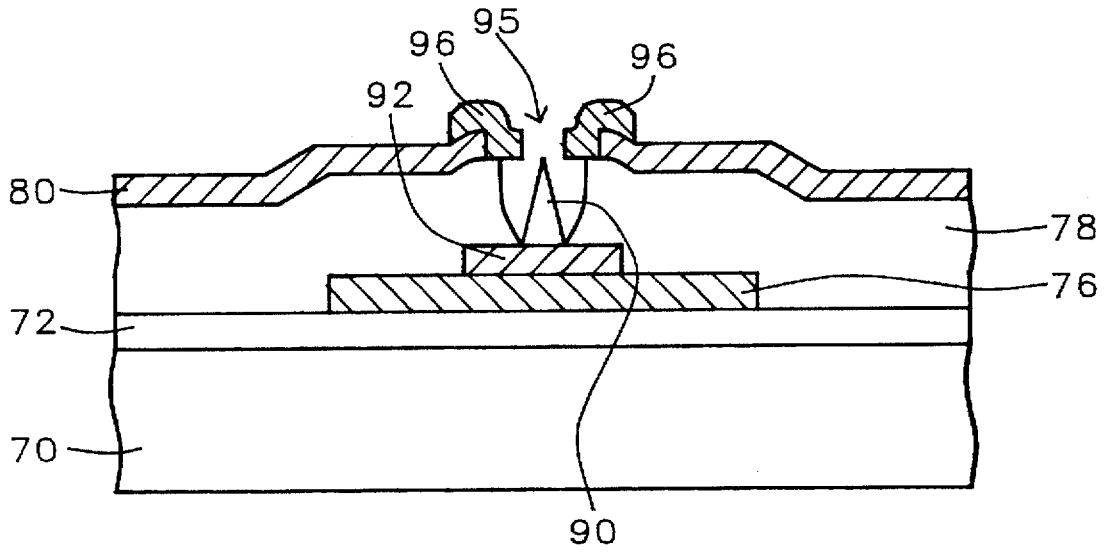
Figure 15:
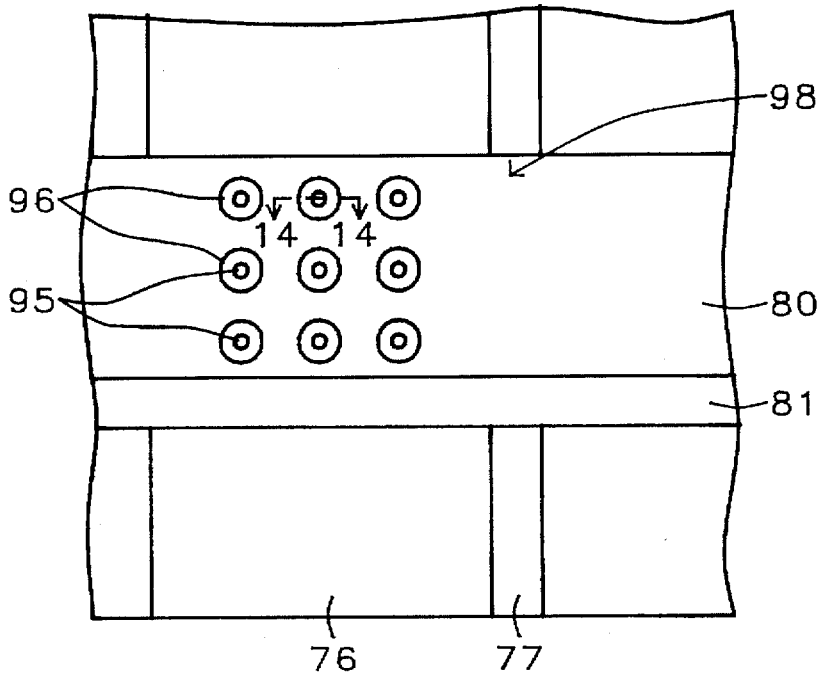

Referring now to FIG. 13, during formation of the auxiliary metal gate electrode (see reference character 33, FIG. 3), metal 94 is deposited and patterned to fill each emitter opening 82. As shown in FIG. 14, openings 95 are formed at each emitter location, to allow for emitter formation, resulting in metal gate ring 96. FIG. 14 is taken along line 14—14 of the top view of FIG. 15, in which a single pixel 98 is depicted with metal gate rings 96 at each emitter location. Also shown are cathode 76, auxiliary cathode electrode 77, gate 80 and auxiliary gate electrode 81. Processing is then completed as described earlier, including deposition of a sacrifical layer, emitter formation and removal of excess emitter material.

While the invention has been particularly shown and described with reference to the preferred embodiments thereof, it will be understood by those skilled in the art that various changes in form and details may be made without departing from the spirit and scope of the invention.

What is claimed is:

1. A field emission display having a baseplate and a faceplate, comprising:

a glass substrate acting as a base for said faceplate;

a reflective, conductive layer over said glass substrate;

a phosphor layer over said reflective, conductive layer;

a second glass substrate, acting as a transparent base for said baseplate, which is mounted opposite and parallel to said faceplate;

a first transparent insulating layer formed over said second glass substrate;

parallel, transparent cathode electrodes over said first transparent insulating layer;

metallic auxiliary cathode electrodes over said parallel, transparent cathode electrodes, having a width less than said parallel, transparent cathode electrodes;

parallel, transparent gate electrodes formed over, separate from, and orthogonally to said parallel, transparent cathode electrodes;

metallic auxiliary gate electrodes over said parallel, transparent gate electrodes, having a width less than said parallel, transparent gate electrodes;

a metal pad under each said field emission microtip, over said parallel, transparent cathode electrodes, and separated from said metallic auxiliary cathode electrodes;

a metal gate ring within each of said plurality of openings and connected to said parallel, transparent gate electrodes, separated from said metallic auxiliary gate electrodes;

a second transparent insulating layer between said parallel, transparent gate electrodes and said parallel, transparent cathode electrodes;

a plurality of openings extending through said second insulating layer and said parallel, transparent gate electrodes; and at each of said openings is a field emission microtip connected to and extending up from one of said parallel, transparent cathode electrodes, whereby electrons may be selectively emitted from each said field emission microtip to form a display image, on said phosphor layer of said faceplate, which is viewable through said baseplate.

2. The field emission display of claim 1 wherein said metallic auxiliary cathode electrodes have a width of between about 5 and 10 percent of the width of said parallel, transparent cathode electrodes.

3. The field emission display of claim 1 wherein said parallel, transparent gate electrodes have a width of between about 5 and 10 percent of the width of said parallel, transparent cathode electrodes.

4. The field emission display of claim 1 wherein said parallel, transparent gate electrodes and said parallel, transparent cathode electrodes are formed of a conductive material selected from the group consisting of indium tin oxide, indium zinc oxide, and cadmium stannate.

5. The field emission display of claim 1 wherein said first and second transparent insulating layers are formed of silicon oxide.

6. A field emission display having a baseplate and a faceplate, comprising:

a glass substrate acting as a base for said faceplate;

a reflective, conductive layer over said glass substrate;

a phosphor layer over said reflective, conductive layer;

a second glass substrate, acting as a transparent base for said baseplate, which is mounted opposite and parallel to said faceplate;

a first insulating layer formed over said second glass substrate;

parallel cathode electrodes over said insulating layer;

parallel gate electrodes formed over, separate from, and orthogonally to said parallel cathode electrodes;

the intersections of said parallel cathode electrodes and said parallel gate electrodes are pixels of said display, wherein said parallel cathode electrodes and said parallel gate electrodes are patterned to cover only a portion of said pixels;

metallic auxiliary cathode electrodes over said parallel cathode electrodes, having a width less than said parallel cathode electrodes;

metallic auxiliary gate electrodes over said parallel gate electrodes, having a width less than said parallel gate electrodes;

a metal pad under each said field emission microtip, over said parallel, transparent cathode electrodes, and separated from said metallic auxiliary cathode electrodes;

a metal gate ring within each of said plurality of openings and connected to said parallel, transparent gate electrodes, separated from said metallic auxiliary gate electrodes;

a second insulating layer between said parallel gate electrodes and said parallel cathode electrodes;

a plurality of openings extending through said second insulating layer and said parallel transparent gate electrodes; and at each of said openings is a field emission microtip connected to and extending up from one of said parallel cathode electrodes.

7. The field emission display of claim 6 wherein said portion of said pixels covered by said parallel cathode electrodes and said parallel gate electrodes is between about 40 and 60 percent.

8. The field emission display of claim 6 wherein said parallel cathode electrodes and said parallel gate electrodes are formed of a conductive transparent material.

9. The field emission display of claim 8 wherein said conductive transparent material is selected from the group consisting of indium tin oxide, indium zinc oxide, and cadmium stannate.

* * * * *